US005595630A

United States Patent [19]

Moffett

[11] Patent Number: 5,595,630

[45] Date of Patent: Jan. 21, 1997

[54] PROCESS FOR THE MANUFACTURE OF PAPER

[75] Inventor: Robert H. Moffett, Landenberg, Pa.

[73] Assignee: E. I. Du Pont de Nemours and Company, Wilmington, D.C.

[21] Appl. No.: 522,452

[22] Filed: Aug. 31, 1995

[51] Int. Cl.[6] ..... D21H 21/10

[52] U.S. Cl. ..... 162/164.1; 162/164.3; 162/164.6; 162/168.1; 162/168.2; 162/168.3; 162/175; 162/178; 162/181.5; 162/181.6; 162/181.8; 162/183

[58] Field of Search ..... 162/181.6, 181.2, 162/181.3, 181.5, 181.8, 183, 168.2, 168.3, 164.6, 164.3, 175, 178, 168.1

[56] References Cited

U.S. PATENT DOCUMENTS

| | | | |
|---|---|---|---|
| 4,385,961 | 5/1983 | Svending et al. | 162/175 |
| 4,643,801 | 2/1987 | Johnson | 162/164.1 |
| 4,755,259 | 7/1988 | Larsson | 162/128 |
| 4,795,531 | 1/1989 | Sofia et al. | 162/164.6 |
| 4,902,382 | 2/1990 | Sakabe | 162/175 |
| 4,927,498 | 5/1990 | Rushmere | 162/168.3 |
| 4,954,220 | 9/1990 | Rushmere | 162/168.3 |
| 4,961,825 | 10/1990 | Anderson et al. | 162/175 |
| 4,964,954 | 10/1990 | Johansson | 162/164.6 |
| 4,980,025 | 12/1990 | Anderson et al. | 162/168.3 |
| 5,126,014 | 6/1992 | Chung | 162/164.6 |
| 5,127,994 | 7/1992 | Johansson | 162/168.3 |

FOREIGN PATENT DOCUMENTS

| | | |
|---|---|---|
| 0357574A2 | 8/1989 | European Pat. Off. . |
| WO91/07351 | 5/1991 | WIPO . |
| WO91/07350 | 5/1991 | WIPO . |

*Primary Examiner*—Peter Chin
*Attorney, Agent, or Firm*—George A. Frank

[57] ABSTRACT

A process for producing paper, utilizing a combination of anionic and cationic aluminum compound additives and providing superior freeness and diminished turbidity, is provided.

6 Claims, No Drawings

PROCESS FOR THE MANUFACTURE OF PAPER

FIELD OF THE INVENTION

This invention relates to an improved process for the manufacture of paper, and, specifically to the use of a combination of a cationic aluminum compound and an anionic aluminum compound in conjunction with a cationic polymer and anionic colloidal microparticles in a paper furnish containing cellulose fibers.

BACKGROUND OF THE INVENTION

Paper production involves the formation and dewatering of a web of cellulose fibers and optional fillers, and is generally performed in the presence of additives which can improve drainage and fines retention.

The use of aluminum compounds in papermaking is well known. Aluminum sulfate, alum, or papermaker's alum, $Al_2(SO_4)_3 \cdot 14H_2O$, is frequently used in paper sizing which provides water resistance in the finished paper and as precipitating or fixing agents to complex added dyes. Sodium aluminate is also widely used in papermaking to permit addition of extra aluminum for sizing and to increase pH.

U.S. Pat. Nos. 4,385,961 (issued May 31, 1983), 4,388,150 (issued Jun. 14, 1983), 4,755,259 (issued Jul. 5, 1988), 4,961,825 (issued Oct. 9, 1990), and 4,980,025 (issued Dec. 25, 1990) disclose papermaking processes which involve use of a binder comprising a colloidal silica and a cationic polymer (starch or polyacrylamide). These patents caution against the use of other paper chemicals such as alum that can interfere with formation of the silica-cationic agglomerate. It is recommended to wait to add such agents until after the agglomerate is formed.

U.S. Pat. No. 4,643,801 (issued Feb. 17, 1987) discloses a papermaking process using a binder comprising a cationic starch and a combination of ( 1 ) an anionic water soluble high molecular weight vinylic polymer of molecular weight at least 500,000 and (2) dispersed silica of particle size ranging from 1–50 nanometers, optionally in the presence of active alumina such as alum, sodium aluminate, or polyaluminum hydroxychloride. There is no suggestion to combine cationic and anionic aluminum compounds to afford additional improvement to the process.

U.S. Pat. No. 4,902,382 (issued Feb. 20, 1990) discloses a process for producing a neutral paper at pH 6–9 which comprises adding to a paper stock slurry of filler and high yield pulp in order, a water soluble cationic aluminum salt, a cationic starch, and bentonite ultrafine clay, and after addition of the bentonite, or preferably, simultaneously with the bentonite, colloidal silica.

U.S. Pat. No. 4,964,954 (issued Oct. 23, 1990) discloses a process for the preparation of paper by forming and dewatering papermaking fibers on a wire at pH >5 in the presence of a synthetic organic cationic polymeric retention agent, polyacrylamide or polyethyleneimine, an anionic inorganic colloid, especially silica sols containing aluminum, and a basic polyaluminum compound with at least 4 aluminum atoms per ion, preferably 10, with a ratio of polyaluminum compound to inorganic colloid of 0.01 to 3:1.

U.S. Pat. No. 5,127,994 (issued Jul. 7, 1992) discloses a process for the production of paper by forming and dewatering a suspension of cellulose containing fibers and optional fillers on a wire in the presence of an aluminum compound, such as alum, polyaluminum compounds, aluminates, aluminum chloride and aluminum nitrate, a cationic polymeric retention agent, preferably cationic starch or cationic polyacrylamide, and a polymeric silicic acid prepared by the acidification of alkali metal silicate having a specific surface area of at least $1050m^2/g$.

European Patent 0 357574 (published Jul. 3, 1990) discloses a process for the production of paper by forming and dewatering a suspension of cellulose containing fibers on a wire in the presence of an anionic inorganic colloid, a cationic synthetic polymer and an aluminate.

While cationic and anionic aluminum compounds have been used individually to improve various aspects of the papermaking process, the combination of these has not been recognized as providing an improvement in drainage and fines retention that is greater than the individual contribution of either aluminum compound.

SUMMARY OF THE INVENTION

The present invention is a process for the manufacture of paper comprising the steps of:

(A) adding to an aqueous paper furnish containing cellulosic fibers
  (i) cationic aluminum compound in a proportional amount X;
  (ii) anionic aluminum compound in a proportional amount 1-X, wherein the combined weight of said aluminum compounds (as $Al_2O_3$) is 0.005–2 weight % based on the dry weight of the furnish;
  (iii) cationic or amphoteric polymer in an amount of 0.05–6 weight % based on the dry weight of the furnish; and
  (iv) anionic colloidal microparticles in an amount of 0.001–2 weight % (as $SiO_2$ or, for bentonite, as solids) based on the dry weight of the furnish; and (B) forming and dewatering the aqueous suspension formed in step (A);

wherein as X is varied from 0 to 1, a plot of Canadian Standard Freehess versus X has a maximum at some amount X, where $O<X<1$ and a plot of turbidity versus X has a minimum at some amount X where $O<X<1$.

Optionally, the paper furnish can contain fillers and one or both of the following high molecular weight anionic polymer (flocculent) or low molecular weight cationic polymer (coagulant).

DETAILED DESCRIPTION OF THE INVENTION

The present invention relates to a process for the manufacture of paper which provides rapid water drainage and good retention of fines by forming and dewatering paper furnish, an aqueous suspension of cellulose containing fibers and optional fillers, in the presence of a cationic aluminum compound, an anionic aluminum compound, a cationic polymer, an anionic colloidal microparticle. Optionally, the paper furnish can also contain a high molecular weight anionic polymer (flocculent) and a low molecular weight cationic polymer (coagulant).

While addition of cationic aluminum compounds such as alum, and anionic aluminum compounds such as sodium aluminate alone to paper stock are known, it has been found surprisingly that the combination of a cationic aluminum compound and an anionic aluminum compound, when added to the paper stock containing known papermaking additives, provides an unexpected improvement in drainage and fines retention during the forming and dewatering steps of the papermaking process.

Cationic aluminum compounds useful in the process of this invention can include alum (aluminum sulfate), aluminum chloride, polyaluminum chlorides, and other cationic aluminum salts and basic aluminum salts. Alum is preferred due to its availability and low cost.

Anionic aluminum compounds useful in the process of this invention can include sodium aluminate and other anionic aluminum salts such as metal aluminates. Sodium aluminate is preferred due to its availability and low cost.

The combined total alumina content (as $Al_2O_3$) from the cationic and anionic aluminum compounds can range from about 0.005% to about 2% (0.1–40 lb/ton or 0.05–20 kg/mt) based on the dry weight of the paper furnish. It is preferable to add from about 0.02% to about 0.5%.

In the process of this invention, the cationic aluminum compound and the anionic aluminum compound are added in such relative amounts that a plot of Canadian Standard Freeness versus X has a maximum value at some amount X where $O<X<1$, and a plot of turbidity versus X has a minimum value at some amount X, where $O<X<1$; X being a proportional amount of cationic aluminum compound and 1-X being a proportional amount of anionic aluminum compound which are added to the furnish. By proportional amount is meant that the anionic and cationic aluminum compound concentrations (as $Al_2O_3$) are expressed as proportions of the combined aluminum compounds (as $Al_2O_3$) as X and 1-X, respectively. Freeness is a measure of drainage rate of the furnish and is measured by the Canadian Standard Freeness test. Turbidity is an indirect measure of solids retention from the furnish and is measured by the turbidity of the white water drained from the Freeness test.

Cationic polymers useful in the process of this invention can include cationic starch, cationic guar gum and high molecular weight synthetic cationic polymers such as cationic polyacrylamide. Cationic starches include those formed by reacting starch with a tertiary or quaternary amine to provide cationic products with a degree of substitution of from 0.01 to 1.0, containing from about 0.01 to 1.0 wt % nitrogen. Suitable starches include potato, corn, waxy maize, wheat, rice and oat. Cationic polymers can be present in amounts ranging from about 0.05% to 6% (or 1 to 120 lb/ton or 0.5–60 kg/mt) based on the dry weight of the paper furnish. The preferred range is from about 0.25% to 2% (5 to 40 lb/ton or 2.5–20 kg/mt). Amphoteric starch, guar gum and synthetic amphoteric high molecular weight polymers can also be used together with or in place of the cationic polymer.

Anionic colloidal microparticles useful in the process of this invention can include polysilicic acid, colloidal silica, aluminum-modified colloidal silica, colloidal bentonite clay, polysilicate microgels and polyaluminosilicate microgels and mixtures thereof. The microgels are distinct from colloidal silica conventionally used in papermaking in that the microgel particles usually have surface areas of 1000 $m^2/g$ or higher and the microgels are small 1–2 nm diameter silica particles linked together into chains and three-dimensional networks. Polysilicate microgels, also known as active silicas, have $SiO_2$:$Na_2O$ ratios of 4:1 to about 25: 1, and are discussed on pages 174–176 and 25–234 of "The Chemistry of Silica" by Ralph K. Iler, published by John Wiley and Sons, N.Y., 1979. Polysilicic acid generally refers to those silicic acids that have been formed and partially polymerized in the pH range 1–4 and comprise silica particles generally smaller than 3–4 nm diameter, which thereafter polymerize into chains and three-dimensional networks. Polysilicic acid can be prepared in accordance with the methods disclosed in U.S. Pat. No. 5,127,994, incorporated herein by reference. Polyaluminosilicates are polysilicate or polysilicic acid microgels in which aluminum has been incorporated within the particles, on the surface of the particles or both.

The polysilicate microgels and polyaluminosilicate microgels useful in this invention are commonly formed by the activation of an alkali metal silicate under conditions described in U.S. Pat. Nos. 4,954,220 (issued Sep. 4, 1990) and 4,927,498 (issued May 22, 1990), incorporated herein by reference. However, other methods can also be employed. These include polyaluminosilicates formed by the acidification of silicate with mineral acids containing dissolved aluminum salts as described in U.S. patent application Ser. No. 08/212,744, filed Mar. 14, 1994, and alumina/silica microgels produced by the acidification of silicate with an excess of alum, as described in U.S. Pat. No. 2,234,285, incorporated herein by reference.

The anionic colloidal microparticles used in this invention can be in the form of a colloidal silica sol containing about 2 to 60% by weight of $SiO_2$, preferably about 4 to 30% by weight of $SiO_2$. Alternatively, the colloid can have particles with at least a surface layer of aluminum silicate or it can be an aluminum modified silica sol. The colloidal silica particles in the sols commonly have a specific surface area of 50–1000 $m^2/g$, more preferably about 200–1000 $m^2/g$, and most preferably a specific surface area of about 300–700 $m^2/g$. The silica sol can be stabilized with alkali in a molar ratio of $SiO_2$:$M_2O$ of from 10:1 to 300: 1, preferably 15:1 to 100:1 (M is Na, K, Li, and $NH_4$). The colloidal particles have a particle size of less than 60 nm, with an average particle size less than 20 nm, and most preferably with an average particle size of from about 1 nm to 10nm.

In addition to silica microgels and conventional silica sols, silica sols such as those described in European patents EP 491879 and EP 502089, incorporated herein by reference, can also be used for the anionic colloidal microparticle in this invention.

The anionic colloidal microparticles are present in amounts ranging from about 0.001% to 2% (0.02 to 40 lb/ton or 0.01 to 20 kg/mt) on a $SiO_2$ basis, based on the dry weight of the paper furnish. The preferred range of addition is from about 0.005% to 0.4% (0.1 to 8 lb/ton or 0.05 to 4 kg/mt).

Anionic high molecular weight polymers (flocculents) which can be optionally used in the process of this invention have number average molecular weights of at least 500,000 and a degree of anionic substitution of at least 1 mol %. Anionic flocculents with molecular weights of greater than 1,000,000 are more preferred, while best results are obtained when the molecular weight is between 5,000,000 and 30,000,000. Preferably the degree of anionic substitution is 10–70 mol %.

The flocculents are preferably water soluble vinylic polymers containing acrylamide, acrylic acid, acrylamido-2-methyl propyl sulfonate and/or mixtures thereof and can also be either hydrolyzed acrylamide polymers or copolymers of acrylamide or its homolog, such as methacrylamide, with acrylic acid or its homolog, such as methacrylic acid, or perhaps even with monomers such as maleic acid, itaconic acid, vinyl sulfonic acid, acrylamido-2-methylpropylsulfonate, and other sulfonate containing monomers. Anionic flocculents have been described, for example, in U.S. Pat. Nos. 4,643,801, 4,795,531, and 5,126,014.

Other anionic polymers which can be used as flocculents include anionic starch, anionic guar and anionic polyvinyl acetate.

The anionic flocculent is preferably added to the paper furnish in an amount from about 0.001% to 0.8% (0.02 to 16 lb/ton or 0.01 to 8 kg/mt) and more preferably from about 0.005% to 0.25% (0.1 to 5 lb/ton or 0.05 to 2.5 kg/mt) based on the dry weight of the furnish.

Cationic low molecular weight polymers (coagulants) which can be optionally used in the process of this invention have a number average molecular weight in the range between about 2,000 to about 500,000, preferably between 10,000 and 500,000. The coagulant can be polyethylene imine, polyamines, polycyandiamide formaldehyde polymers, amphoteric polymers, diallyl dimethyl ammonium chloride polymers, diallylaminoalkyl (meth)acrylate polymers and dialkylaminoalkyl (meth)acrylamide polymers, a copolymer of acrylamide and diallyl dimethyl ammonium chloride, a copolymer of acrylamide and diallylaminoalkyl (meth)acrylates, a copolymer of acrylamide and dialkylaminoalkyl (meth)acrylamides, and a polymer of dimethylamine and epichlorohydrin. These have been described in U.S. Pat. Nos. 4,795,531 and 5,126,014.

The cationic coagulant is preferably added to the paper furnish in an amount from about 0.00005% to 1.25% (0.001 to about 25 lb/ton or 0.0005 to 12.5 kg/mt) preferably from about 0.001% to 0.5% (0.02 to 10 lb/ton or 0.01 to 5 kg/mt) based on the dry weight of the furnish.

Papermaking furnishes useful in the process of this invention are suspensions of cellulosic materials in water and optionally contain inorganic fillers. The cellulosic materials are most commonly wood pulps derived from various sources such as bleached kraft pulp, thermochemical pulp and groundwood. Mixtures of pulps, including recycled pulp or broke with mixtures of fillers are frequently used. Inorganic fillers include clay, precipitated calcium carbonate, and titanium dioxide. The cellulosic materials generally comprise at least 50% of the total solids, and more usually, at least 70%. The pH of the furnish is within the range of pH 3–10.

The components of the suspension prepared in the process of this invention can be added to the paper furnish as dilute solutions containing from about 0.01–1 wt % of dissolved solids. The order of addition is not critical and the components can be added separately or premixed when compatible. Thus anionic colloidal microparticles can be premixed with an anionic flocculent. Cationic starch can be premixed with a polyamine or other cationic polymers. Some of the cationic or anionic aluminum compound can be mixed with the anionic colloidal microparticles prior to addition to the furnish. Best results in the process of this invention are achieved when the following order of addition to the furnish is followed: first cationic aluminum compound and anionic aluminum compound, separately but substantially simultaneously, then cationic low molecular weight coagulant polymer, followed by cationic high molecular weight polymer, then anionic colloidal microparticles, and, finally anionic high molecular weight flocculent polymer.

The following Examples illustrate the process of this invention. Drainage measurements were carried out using the Canadian Standard Freeness Test. Turbidity measurements of the white water from the freeness test provided an accompanying measure of degree of retention of pulp fines and filler. Mixing was conducted in a Britt Jar at an agitator speed of 750 rpm. In all Examples, the same conditions of mixing and order of addition of components were maintained. All weights are based on the dry weight of the furnish.

EXAMPLE 1

Preparation of Paper using Cationic Alum/Anionic Sodium Aluminate Combination and Polysilicic Acid Microgel in Groundwood Paper Furnish An unbleached groundwood paper furnish of 0.3 wt % consistency (solids content) at pH 8 was used, wherein the solids contained 80% pulp and 20% clay filler.

The following ingredients were added to the furnish in all runs: alum, sodium aluminate (both in amounts given in Table 1 ), cationic potato starch with a degree of substitution of 0.03, BMB-40 (40 lb/ton), available from Akzo Nobel, and polysilicic acid microgel, 4 lb ($SiO_2$ basis)/ton.

Polysilicic acid microgel was prepared following a similar procedure to that described in U.S. Pat. No. 4,954,220. Dowex®50W-XS(H+), a strong sulfonic acid polystyrene ion exchange resin in the acid form, 200 g, was added batch-wise to 292 g of a well stirred dilute sodium silicate solution containing 5 wt % $SiO_2$. About 3 minutes after the pH of the mixture reached 3.0, the resin was removed by filtration. The filtrate, 5% $SiO_2$ solution, was allowed to stand for 1 hour and then diluted to 1.0 wt % $SiO_2$ for stabilization. Water was added to dilute the 1.0 wt % solution to 0.125 wt % for use in preparing the suspensions.

The ingredients were added as follows for all of the runs in this Example; quantities are shown in Table 1:

(1) furnish was added to Britt jar and stirred for 15 seconds;

(2) both aluminum compounds were addedseparately and simultaneously and stirred for 15 seconds;

(3) cationic potato starch, 40 lb per ton, based on the dry weight of the pulp, was added and stirred for 15 seconds;

(4) polysilicic acid microgel, 4 lb (on an $SiO_2$basis) per ton, based on the dry weight of the furnish, as added and stirred for 15 seconds.

The flocculated furnish contained in the Britt Jar was then transferred to the Canadian Standard Freeness tester and the freeness was determined. The turbidity of the water drained from the Freeness tester (white water) was measured on a Hach Ratio Turbidity Meter as an indication of fines retention. Results are presented in Table 1.

TABLE 1

| Alum (lb/ton) as $Al_2O_3$ | Sodium Aluminate (lb/ton) as $Al_2O_3$ | Freeness | Turbidity |
|---|---|---|---|
| 0.0 | 0.0 | 240 | 64 |
| 1.0 | 0.0 | 400 | 18 |
| 0.6 | 0.4 | 430 | 13 |
| 0.0 | 1.0 | 345 | 60 |
| 2.0 | 0.0 | 410 | 14 |
| 0.8 | 1.2 | 500 | 6 |
| 0.0 | 2.0 | 375 | 58 |
| 3.0 | 0.0 | 310 | 43 |
| 0.9 | 2.1 | 550 | 5 |
| 0.0 | 3.0 | 330 | 50 |

The results in Table 1 grouped by threes based on total weight of aluminum reagent, show that the combination of cationic alum and anionic sodium aluminate (line 2 in each triad) unexpectedly gives improved freeness and turbidity when compared to either aluminum source alone.

EXAMPLE 2

Preparation of Paper using Cationic Alum/Anionic Sodium Aluminate Combination and Polysilicate Microgel in Groundwood Paper Furnish The process of Example 1 was repeated with the same furnish, alum, sodium aluminate, and starch, but using a polysilicate microgel. Quantities of Al compounds are given in Table 2; starch added was 40 lb/ton and microgel added was 4 lb ($SiO_2$ basis)/ton.

The polysilicate microgel was prepared by the following procedure: 295 g of a dilute sodium silicate solution containing 2.0 wt % $SiO_2$ with a pH of about 11.6 was mixed with sufficient sulfuric acid to reduce the pH to 9.0. The resulting solution was aged for 5 minutes and water was added to dilute to 0.125 wt % $SiO_2$.

Table 2 presents the results from the Canadian Standard Freeness test and turbidity measurements at a total alumina content (anionic plus cationic) of 2 lb/ton. The first and last data lines show controls where either only anionic or cationic Al compound was used outside of this invention.

TABLE 2

| Alum (lb/ton) as $Al_2O_3$ | Sodium Aluminate (lb/ton) as $Al_2O_3$ | Freeness | Turbidity |
|---|---|---|---|
| 2.0 | 0.0 | 380 | 28 |
| 1.6 | 0.4 | 420 | 15 |
| 1.2 | 0.8 | 455 | 11 |
| 0.8 | 1.2 | 490 | 7 |
| 0.4 | 1.6 | 430 | 22 |
| 0.0 | 2.0 | 340 | 49 |

As can be seen from Table 2, combinations of cationic alum and anionic sodium aluminate give improved freeness and turbidity when compared to either aluminum source alone.

EXAMPLE 3

Preparation of Paper using Cationic Alum/Anionic Sodium Aluminate Combination and Colloidal Silica in Groundwood Paper Furnish The process of Example 1 was repeated utilizing the same quantities of furnish, alum, sodium aluminate and starch (at 40 lb/ton) and as the anionic colloidal microparticles a commercial colloidal silica, BMA-0, having an average surface area of 550 $m^2/g$ (available from Akzo Nobel) at a loading of 8 lb (on an $SiO_2$ basis) per ton.

Table 3 presents the results from the Canadian Standard Freeness tester and turbidity measurements at a total alumina content (anionic and cationic) of 2 lb/ton. The first and last data lines show controls where either only artionic or cationic aluminum compound was used outside of this invention.

TABLE 3

| Alum (lb/ton) as $Al_2O_3$ | Sodium Aluminate (lb/ton) as $Al_2O_3$ | Freeness | Turbidity |
|---|---|---|---|
| 2.0 | 0.0 | 420 | 31 |
| 1.6 | 0.4 | 475 | 16 |
| 1.2 | 0.8 | 520 | 10 |
| 0.8 | 1.2 | 565 | 4 |
| 0.4 | 1.6 | 540 | 13 |
| 0.0 | 2.0 | 420 | 36 |

As can be seen in Table 3, combinations of cationic alum and anionic sodium aluminate give improved freeness and turbidity when compared to either aluminum source alone.

EXAMPLE 4

Preparation of Paper using Cationic Alum/Anionic Sodium Aluminate Combination and Polyaluminosilicate Microgel in Groundwood Paper Furnish The process of Example 1 was repeated with the same furnish, alum, sodium aluminate, and starch (40 lb/ton), but using a polyaluminosilicate microgel at two different levels, 4 lb/ton and 6 lb/ton, respectively, on $SiO_2$ basis.

Polyaluminosilicate microgel was prepared by mixing 100 g of polysilicic acid prepared as described in Example 1, containing 1.0 wt % $SiO_2$, with dilute sodium aluminate containing 1.0 wt % $Al_2O_3$ to yield an $Al_2O_3$:$SiO_2$ weight ratio of 1:30. The resulting solution was mixed for 20 minutes and then water was added to dilute to 0.125 wt % on a polyaluminosilicate basis.

Tables 4A and 4B present the results from the Canadian Standard Freeness test and turbidity measurements at total alumina contents (anionic and cationic) of 1, 2, and 3 lb/ton. The first and last lines of each grouping of six show controls where either only anionic or cationic aluminum compound was used outside of this invention.

TABLE 4A

| 4 lb/ton polyaluminosilicate microgel | | | |
|---|---|---|---|
| Alum (lb/ton) as $Al_2O_3$ | Sodium Aluminate (lb/ton) as $Al_2O_3$ | Freeness | Turbidity |
| 0.0 | 0.0 | 300 | 57 |
| 1.0 | 0.0 | 455 | 19 |
| 0.8 | 0.2 | 460 | 15 |
| 0.6 | 0.4 | 475 | 5 |
| 0.4 | 0.6 | 420 | 26 |
| 0.2 | 0.8 | 390 | 37 |
| 0.0 | 1.0 | 360 | 45 |
| 2.0 | 0.0 | 450 | 7 |
| 1.6 | 0.4 | 500 | 6 |
| 1.2 | 0.8 | 520 | 6 |
| 0.8 | 1.2 | 515 | 5 |
| 0.4 | 1.6 | 430 | 23 |
| 0.0 | 2.0 | 370 | 43 |
| 3.0 | 0.0 | 375 | 28 |
| 2.4 | 0.6 | 410 | 14 |
| 1.8 | 1.2 | 470 | 11 |
| 1.2 | 1.8 | 525 | 5 |
| 0.6 | 2.4 | 480 | 7 |
| 0.0 | 3.0 | 370 | 45 |

TABLE 4B

| 6 lb/ton polyaluminosilicate microgel | | | |
|---|---|---|---|
| Alum (lb/ton) as $Al_2O_3$ | Sodium Aluminate (lb/ton) as $Al_2O_3$ | Freeness | Turbidity |
| 0.0 | 0.0 | 305 | 59 |
| 1.0 | 0.0 | 480 | 19 |
| 0.8 | 0.2 | 480 | 17 |
| 0.6 | 0.4 | 465 | 17 |
| 0.4 | 0.6 | 445 | 24 |
| 0.2 | 0.8 | 410 | 36 |
| 0.0 | 1.0 | 370 | 53 |
| 2.0 | 0.0 | 535 | 7 |
| 1.6 | 0.4 | 545 | 5 |
| 1.2 | 0.8 | 550 | 5 |
| 0.8 | 1.2 | 530 | 5 |

TABLE 4B-continued

| 6 lb/ton polyaluminosilicate microgel | | | |
|---|---|---|---|
| Alum (lb/ton) as $Al_2O_3$ | Sodium Aluminate (lb/ton) as $Al_2O_3$ | Freeness | Turbidity |
| 0.4 | 1.6 | 420 | 35 |
| 0.0 | 2.0 | 380 | 59 |
| 3.0 | 0.0 | 460 | 11 |
| 2.4 | 0.6 | 490 | 8 |
| 1.8 | 1.2 | 550 | 5 |
| 1.2 | 1.8 | 560 | 3 |
| 0.6 | 2.4 | 485 | 20 |
| 0.0 | 3.0 | 400 | 41 |

As can be seen in Tables 4A and 4B, improvements in freeness and turbidity result when combinations of cationic and anionic aluminum compounds are used with polyaluminosilicate microgel. In comparison to the use of a single aluminum compound, there is a least one (and usually several) weight combinations of anionic and cationic aluminum compounds which provide improved properties and, therefore, afford freeness maxima and turbidity minima when plotted against fractional aluminum content.

EXAMPLE 5

Preparation of Paper using Cationic Alum/Anionic Sodium Aluminate Combination and Aluminum Modified Colloidal Silica in Groundwood Paper Furnish The process of Example 1 was repeated utilizing the same quantities of furnish, alum, sodium aluminate and starch (at 40 lb/ton) and as the anionic colloidal microparticles a commercial aluminum modified colloidal silica, BMA-9, having an average surface area of 500 $m^2/g$ (available from Akzo Nobel) at a loading of 8 lb (on an $SiO_2$ basis) per ton, based on the dry weight of the pulp.

Table 5 presents the results from the Canadian Standard Freeness test and turbidity measurements at a total alumina content (anionic and cationic) of 3 lb/ton. The first and last data lines show controls where either only anionic or cationic aluminum compound was used outside of this invention.

TABLE 5

| Alum (lb/ton) as $Al_2O_3$ | Sodium Aluminate (lb/ton) as $Al_2O_3$ | Freeness | Turbidity |
|---|---|---|---|
| 3.0 | 0.0 | 370 | 31 |
| 2.4 | 0.6 | 415 | 7 |
| 1.8 | 1.2 | 440 | 14 |
| 1.2 | 1.8 | 470 | 14 |
| 0.6 | 2.4 | 400 | 33 |
| 0.0 | 3.0 | 300 | 68 |

As can be seen in Table 5, combinations of cationic alum and anionic sodium aluminate give improved freeness and turbidity when compared to either aluminum source alone. In this example, the best results (maximum freeness and minimum turbidity) do not occur at the same weight ratio of alum and sodium aluminate, showing that freeness and turbidity do not always track each other.

EXAMPLE 6

Preparation of Paper using Cationic Alum/Anionic Sodium Aluminate Combination and Aluminum Modified Silica Sol Microgel in Groundwood Paper Furnish The process of Example 1 was repeated utilizing the same quantities of furnish, alum, sodium aluminate and starch (at 40 lb/ton) and as the anionic colloidal microparticle an aluminum modified silica sol microgel, prepared according to the procedure described in EP 491879, Example 1 C, 4 lb/ton ($SiO_2$ basis).

Table 6 presents the results from the Canadian Standard Freeness test and turbidity measurements at a total alumina content (anionic and cationic) of 3 lb/ton. The first, second and last data lines show controls where no aluminum compound or either only anionic or cationic aluminum compound was used outside of this invention.

TABLE 6

| Alum (lb/ton) as $Al_2O_3$ | Sodium Aluminate (lb/ton) as $Al_2O_3$ | Freeness | Turbidity |
|---|---|---|---|
| 0.0 | 0.0 | 220 | 92 |
| 3.0 | 0.0 | 340 | 35 |
| 2.4 | 0.6 | 390 | 33 |
| 1.8 | 1.2 | 450 | 16 |
| 1.2 | 1.8 | 520 | 7 |
| 0.6 | 2.4 | 420 | 39 |
| 0.0 | 3.0 | 340 | 72 |

As can be seen in Table 6, combinations of cationic alum and anionic sodium aluminate give improved freeness and turbidity when compared to either aluminum source alone.

EXAMPLE 7

Preparation of Paper using Cationic Alum/Anionic Sodium Aluminate Combination and Alkaline Silica Sol in Groundwood Paver Furnish The process of Example 1 was repeated utilizing the same quantities of furnish, alum, sodium aluminate and starch (at 40 lb/ton) and as the anionic colloidal microparticles a silica sol prepared according to the procedure described in EP 502089, Example 1B, 4 lb/ton ($SiO_2$ basis).

Table 7 presents the results from the Canadian Standard Freeness test and turbidity measurements at a total alumina content (anionic and cationic) of 3 lb/ton. The first, second and last data lines show controls where no aluminum compound or either only anionic or cationic aluminum compound was used outside of this invention.

TABLE 7

| Alum (lb/ton) as $Al_2O_3$ | Sodium Aluminate (lb/ton) as $Al_2O_3$ | Freeness | Turbidity |
|---|---|---|---|
| 0.0 | 0.0 | 210 | 118 |
| 3.0 | 0.0 | 350 | 30 |
| 2.4 | 0.6 | 430 | 16 |
| 1.8 | 1.2 | 480 | 10 |
| 1.2 | 1.8 | 535 | 6 |
| 0.6 | 2.4 | 440 | 42 |
| 0.0 | 3.0 | 350 | 87 |

As can be seen in Table 7, combinations of cationic alum and anionic sodium aluminate give improved freeness and turbidity when compared to either aluminum source alone.

EXAMPLE 8

Preparation of Paper using Cationic Aluminum Chloride/Anionic Sodium Aluminate Combination and Polysilicic Acid Microgel in Groundwood Paper Furnish The process of Example 1 was repeated with the same furnish, sodium aluminate, starch (40 lb/ton), and polysilicic acid (4 lb/ton, $SiO_2$ basis) but using aluminum chloride as the cationic aluminum source.

Table 8 presents the results from the Canadian Standard Freeness test and turbidity measurements at a total alumina content (anionic plus cationic) of 3 lb/ton based on dry furnish weight. The first and last data lines show controls where either only anionic or cationic aluminum compound was used outside of this invention.

TABLE 8

| $AlCl_3$ (lb/ton) as $Al_2O_3$ | Sodium Aluminate (lb/ton) as $Al_2O_3$ | Freeness | Turbidity |
|---|---|---|---|
| 3.0 | 0.0 | 460 | 14 |
| 2.4 | 0.6 | 480 | 9 |
| 1.8 | 1.2 | 510 | 11 |
| 1.2 | 1.8 | 505 | 18 |
| 0.6 | 2.4 | 450 | 41 |
| 0.0 | 0.0 | 375 | 68 |

As can be seen in Table 8, combinations of cationic aluminum chloride and anionic sodium aluminate give improved freeness and turbidity when compared to either aluminum source alone. The best results (maximum freeness and minimum turbidity) do not occur at the same combination of aluminum chloride and sodium aluminate, showing that freeness and turbidity do not always track each other.

EXAMPLE 9

Preparation of Paper using Cationic Alum/Anionic Sodium Aluminate Combination and Polysilicic Acid in Kraft Paper Furnish The process of Example 1 was repeated using a bleached kraft furnish containing a 50/50 blend of bleached kraft hardwood and softwood and 30% clay. The furnish consistency was 0.3% solids. Alum, sodium aluminate, BMB-40 starch (40 lb/ton) and polysilicic acid (4 lb/ton, $SiO_2$ basis)were added to the furnish following the procedure of Example 1.

Table 9 presents the results from the Canadian Standard Freeness test and turbidity measurements at 3 lb/ton of total alumina to dry weight of furnish and at 4 lb polysilicic acid per ton of dry furnish weight.

TABLE 9

| Alum (lb/ton) as $Al_2O_3$ | Sodium Aluminate (lb/ton) as $Al_2O_3$ | Freeness | Turbidity |
|---|---|---|---|
| 3.0 | 0.0 | 630 | 8 |
| 2.4 | 0.6 | 630 | 8 |
| 1.8 | 1.2 | 660 | 6 |
| 1.2 | 1.8 | 685 | 4 |
| 0.6 | 2.4 | 710 | 2 |
| 0.3 | 2.7 | 725 | 3 |
| 0.15 | 2.85 | 750 | 4 |
| 0.0 | 3.0 | 730 | 5 |

As can be seen in Table 9, combinations of cationic alum and anionic sodium aluminate give improved freeness and turbidity when compared to either aluminum source alone.

EXAMPLE 10

Preparation of Paper using Cationic Alum/Anionic Sodium Aluminate Combination and Polysilicic Acid and Cationic Coagulant in Groundwood Paper Furnish The process of Example 1 was repeated with the same quantities of furnish, alum, sodium aluminate, and polysilicic acid but using 20 lb/ton of starch and, additionally, 2.67 lb/ton of diallyldimethylammonium chloride polymer (polydadmac), a low molecular weight cationic polymer (coagulant).

The ingredients were added as follows:

(1) furnish was added to Britt Jar and stirred for 15 seconds;

(2) polydadmac, 2.67 lb/ton, based on the dry weight of the pulp, was added to furnish and stirred for 15 seconds;

(3) both aluminum compounds were added separately and simultaneously and stirred for 15 seconds;

(4) cationic potato starch, 20 lb per ton, based on the dry weight of the pulp, was added and stirred for 15 seconds;

(5) polysilicic acid microgel, 4 lb (on an $SiO_2$ basis) per ton, based on the dry weight of the pulp, was added and stirred for 15 seconds.

The flocculated furnish contained in the Britt Jar was then transferred to the Canadian Standard Freeness tester and the freeness and turbidity of the white water were determined. Results are presented in Table 10. The first and last data lines show controls where either only anionic or cationic aluminum compound was used.

TABLE 10

| Alum (lb/ton) as $Al_2O_3$ | Sodium Aluminate (lb/ton) as $Al_2O_3$ | Freeness | Turbidity |
|---|---|---|---|
| 3.0 | 0.0 | 335 | 25 |
| 2.4 | 0.6 | 330 | 25 |
| 1.8 | 1.2 | 370 | 21 |
| 1.2 | 1.8 | 390 | 18 |
| 0.6 | 2.4 | 360 | 21 |
| 0.0 | 3.0 | 350 | 32 |

As can be seen in Table 10, combinations of cationic alum and anionic sodium aluminate give improved freeness and turbidity when compared to either aluminum source alone.

EXAMPLE 11

Preparation of Paper using Cationic Alum/Anionic Sodium Aluminate Combination and Aluminum Modified Colloidal Silica in Acidic Groundwood Paper Furnish The process of Example 1 was repeated, using alum, sodium aluminate, and cationic potato starch, BMB-40, available from Akzo Nobel. An unbleached groundwood paper furnish of 0.3 wt % consistency at pH 4 was used with suspended solids comprised of 80% pulp and 20% clay. An aluminum modified colloidal silica, BMA-9 (available from Akzo Nobel) was utilized as the anionic colloidal microparticles.

The same mixing and addition sequence were followed as in Example 1. The amounts of cationic starch and colloidal silica were 20 lb/ton and 8 lb/ton, respectively, based on the dry weight of the furnish.

Table 11 presents the results from the Canadian Standard Freeness tester and turbidity measurements at a total alumina content of 5 lb/ton.

TABLE 11

| Alum (lb/ton) as $Al_2O_3$ | Sodium Aluminate (lb/ton) as $Al_2O_3$ | Freeness | Turbidity |
|---|---|---|---|
| 5 | 0 | 280 | 36 |
| 4 | 1 | 250 | 51 |
| 3 | 2 | 240 | 52 |
| 2 | 3 | 310 | 29 |
| 1 | 4 | 375 | 18 |
| 0 | 5 | 280 | 43 |

As can be seen in Table 11, some combinations of cationic alum and anionic sodium aluminate give improved freeness and turbidity when compared to either aluminum source alone.

COMPARATIVE EXAMPLE

Preparation of Paper using Two Cationic Aluminum Compounds and Polysilicic Acid in Groundwood Paper Furnish As a control, the process of Example 1 was repeated with the same furnish, starch (40 lb/ton), and polysilicic acid (4 lb/ton, $SiO_2$ basis)but using two cationic aluminum compounds, alum and aluminum chloride. No anionic aluminum compound was used.

Table 12 presents the results from the Canadian Standard Freeness test and turbidity measurements at 3 lb/ton of total alumina per ton of dry furnish weight.

TABLE 12

| Alum (lb/ton) as $Al_2O_3$ | Sodium Aluminate (lb/ton) as $Al_2O_3$ | Freeness | Turbidity |
|---|---|---|---|
| 3.0 | 0.0 | 470 | 10 |
| 2.4 | 0.6 | 420 | 20 |
| 1.8 | 1.2 | 400 | 23 |
| 1.2 | 1.8 | 410 | 27 |
| 0.6 | 2.4 | 380 | 30 |
| 0.0 | 3.0 | 370 | 35 |

As can be seen from Table 12, no synergistic improvement in freeness and turbidity occurs when combinations of two cationic aluminum compounds are used outside the scope of this invention and there is no maximum freeness or minimum turbidity in the plots versus aluminum content.

I claim:

1. A process for the manufacture of paper comprising the steps of:

(A) adding to an aqueous paper furnish containing cellulosic fibers (i) cationic aluminum compound in a proportional amount X;

(ii) artionic aluminum compound in a proportional amount 1-X, wherein the combined weight of said aluminum compounds (as $Al_2O_3$) is 0.005–2 weight % based on the dry weight of the furnish;

(iii) cationic or amphoteric polymer in an amount of 0.05–6 weight % based on the dry weight of the furnish; and (iv) anionic colloidal microparticles in an amount of 0.001–2 weight % (as $SiO_2$ or, for bentonire, as solids) based on the dry weight of the furnish; and (B) forming and dewatering the aqueous suspension formed in step (A);

wherein as X is varied from 0 to 1, a plot of Canadian Standard Freeness versus X has a maximum at some amount X, where $O<X<1$ and a plot of turbidity versus X has a minimum at some amount X where $O<X<1$.

2. The process of claim 1 wherein said cationic aluminum compound is alum.

3. The process of claim 1 wherein said anionic aluminum compound is sodium aluminate.

4. The process of claim 1 wherein said anionic colloidal microparticle is polysilicate microgel or polyaluminosilicate microgel.

5. The process of claim 1 wherein an anionic flocculent high molecular weight polymer, having a number average molecular weight of at least 500,000 and a degree of anionic substitution of at least 1 mol %, is added in step (A) in an amount of 0.001–0.8 weight % based on the dry weight of the furnish.

6. The process of claim 1 wherein a cationic low molecular weight polymer, having a number average molecular weight of 2,000–500,000, is added in step (A) in an amount of 0.0005–1.25 weight % based on the dry weight of the furnish.

* * * * *

UNITED STATES PATENT AND TRADEMARK OFFICE
CERTIFICATE OF CORRECTION

PATENT NO. : 5,595,630

DATED : January 21, 1997

INVENTOR(S) : Robert Harvey Moffett

It is certified that error appears in the above-identified patent and that said Letters Patent is hereby corrected as shown below:

Delete in claim 1, (A)(ii), "artionic", and substitute -- anionic -- therefor.

Delete in claim 1, (A)(iv), "bentonire",and substitute -- bentonite -- therefor.

Signed and Sealed this

Eighth Day of April, 1997

*Attest:*

*Attesting Officer*

BRUCE LEHMAN

*Commissioner of Patents and Trademarks*